US009982965B2

(12) United States Patent
Sun

(10) Patent No.: US 9,982,965 B2
(45) Date of Patent: May 29, 2018

(54) INNER RED-DOT GUN SIGHTING DEVICE POWERED BY SOLAR CELL AND PROVIDED WITH MICRO-CURRENT LED LIGHT SOURCE

(71) Applicant: HUANIC CORPORATION, Xi'an, Shaanxi (CN)

(72) Inventor: Jianhua Sun, Shaanxi (CN)

(73) Assignee: HUANIC CORPORATION, Shaanxi (CN)

( * ) Notice: Subject to any disclaimer, the term of this patent is extended or adjusted under 35 U.S.C. 154(b) by 0 days. days.

(21) Appl. No.: 15/122,894

(22) PCT Filed: May 25, 2014

(86) PCT No.: PCT/CN2014/078360

§ 371 (c)(1),
(2) Date: Aug. 31, 2016

(87) PCT Pub. No.: WO2015/131452

PCT Pub. Date: Sep. 11, 2015

(65) Prior Publication Data

US 2017/0038177 A1 Feb. 9, 2017

(30) Foreign Application Priority Data

Mar. 1, 2014 (CN) ..... 2014 2 0092959 U
Mar. 2, 2014 (CN) ..... 2014 1 0071368
(Continued)

(51) Int. Cl.
*F41G 1/34* (2006.01)
*F41G 1/30* (2006.01)
*F41G 11/00* (2006.01)

(52) U.S. Cl.
CPC ..... *F41G 1/345* (2013.01); *F41G 1/30* (2013.01); *F41G 11/003* (2013.01)

(58) Field of Classification Search
CPC ..... F41G 1/345; F41G 1/30; F41G 11/003; F41G 1/36
(Continued)

(56) References Cited

U.S. PATENT DOCUMENTS 5,189,555 A * 2/1993 Jorlov ..... G02B 23/105 356/247
6,519,889 B1 * 2/2003 Schlierbach ..... G02B 23/105 356/251
(Continued)

FOREIGN PATENT DOCUMENTS

CN 2463779 Y 12/2001
CN 2809578 Y 8/2006
(Continued)

OTHER PUBLICATIONS

International Search Report for PCT/CN2014/078360, dated Nov. 21, 2014.

*Primary Examiner* — Joshua E Freeman
(74) *Attorney, Agent, or Firm* — Amster, Rothstein & Ebenstein LLP

(57) ABSTRACT

An inner red-dot gun sighting device powered by a solar cell and provided with a micro-current LED light source comprises a housing (1) and a micro-current LED light source (6) disposed in the housing (1) or on the housing (1). A solar cell (2) is disposed on the housing (1). The solar cell (2) is connected to the micro-current LED light source (6) by using a conducting wire, so as to supply power to the micro-current LED light source (6). Power is supplied to the micro-current LED light source (6) by using the solar cell (2), so that the number of cells used is reduced and use costs are reduced; power supplies of the micro-current LED light source (6) are switched by using a dual-power supply automatic switching module. In a sunny environment, power is supplied to the micro-current LED light source (6) by
(Continued)

using the solar cell (2), so that the brightness of output light of the micro-current LED light source (6) of the inner red-dot gun sighting device is automatically adjusted according to the change of the brightness of the environment, without relying on any control circuit and without requiring the cell to supply power. At night, power is supplied by using the cell, thereby ensuring the normal use of the sighting device.

18 Claims, 10 Drawing Sheets

(30) Foreign Application Priority Data

Mar. 19, 2014 (CN) ..... 2014 2 0124704 U
Mar. 19, 2014 (CN) ..... 2014 2 0124716 U
Apr. 23, 2014 (CN) ..... 2014 2 0198235 U
Apr. 23, 2014 (CN) ..... 2014 2 0198358 U

(58) Field of Classification Search
USPC ..... 42/113, 132
See application file for complete search history.

(56) References Cited

U.S. PATENT DOCUMENTS 8,671,611 B2 * 3/2014 Ostergren ..... F41G 1/30 33/297
8,925,238 B2 * 1/2015 Anderson ..... F41G 1/08 42/114
9,163,902 B1 * 10/2015 Cheng ..... F41G 1/38
2002/0191401 A1 * 12/2002 He ..... F21S 8/00 362/257
2003/0012015 A1 * 1/2003 Schiller ..... F41G 1/30 362/110
2007/0214701 A1 9/2007 Grauslys et al.
2007/0267058 A1 * 11/2007 Naum ..... H01L 31/055 136/255
2009/0288324 A1 * 11/2009 Peterson ..... F41A 11/02 42/75.03
2010/0083554 A1 * 4/2010 Elpedes ..... F41G 1/14 42/123
2011/0154713 A1 * 6/2011 Jung ..... F41G 1/30 42/137
2012/0042560 A1 * 2/2012 Jackson ..... F41A 33/02 42/116
2012/0055063 A1 * 3/2012 Lindau ..... F41G 1/30 42/113
2012/0151816 A1 * 6/2012 Kleck ..... F41G 1/30 42/132
2012/0327247 A1 * 12/2012 Mironichev ..... F41G 1/32 348/164
2013/0061510 A1 * 3/2013 Ostergren ..... F41G 1/30 42/123
2013/0098344 A1 * 4/2013 Morris, II ..... F41B 5/1484 124/25.6
2013/0112879 A1 * 5/2013 Meyers ..... G01J 5/02 250/341.8
2013/0152447 A1 * 6/2013 Ostergren ..... F41G 1/30 42/123
2013/0194435 A1 * 8/2013 Lupher ..... F41G 3/165 348/207.1
2013/0333266 A1 * 12/2013 Gose ..... F41G 1/00 42/111
2014/0237884 A1 * 8/2014 Koesler ..... F41G 1/30 42/119
2016/0102943 A1 * 4/2016 Teetzel ..... F41G 1/35 42/113
2016/0356573 A1 * 12/2016 Berlips ..... F41G 1/38
2017/0038177 A1 * 2/2017 Sun ..... F41G 1/30

FOREIGN PATENT DOCUMENTS

CN 102032840 A 4/2014
CN 103954173 A 7/2014
EP 0545527 A1 6/1993
RU 94018842 A1 5/1997
TW I258561 B 7/2006

* cited by examiner

INNER RED-DOT GUN SIGHTING DEVICE POWERED BY SOLAR CELL AND PROVIDED WITH MICRO-CURRENT LED LIGHT SOURCE

TECHNICAL FIELD

The present invention relates to the art of photo-electrical technics, and more particularly, to a micro-current LED light source or a module of the same, especially to an inner red-dot gun sighting device powered by solar cell and provided with micro-current led light source.

BACKGROUND

Most of the existing inner red-dot sighting devices use cells, such as lithium to provide power needed by the inner red-dot module (using LED as the light source) when working. The cells have limited lifetimes and should be replaced, increasing the cost. Further, during using, since the light in the outside environment changes, the current or voltage supplied by the cell should be adjusted, so as to achieve adjusting the luminance of the light emitted from the inner red-dot module. For example, when the environment luminance increases, the luminance of the light emitted from the inner red-dot module should be increased. Conversely, the luminance of the light emitted from the inner red-dot module should be decreased. Such inner red-dot sighting device relies on the power supplied by the cell day and night, increasing replacement cost for the cells. Besides the above-mentioned inner red-dot sighting device, most of the current lighting devices or auxiliary sighting devices use LED as the light source, and most of them are powered by cells which should be replaced frequently, increasing the using cost.

SUMMARY

An object of the present invention is to provide an inner red-dot gun sighting device powered by solar cell and provided with micro-current led light source, which can decrease the using of a cell by means of the LED light source powered by the solar cell, so as to decrease the using cost.

To obtain the above-mentioned object, the present invention provides an inner red-dot gun sighting device powered by a solar cell and provided with a micro-current LED light source, comprising a housing, a micro-current LED light source provided in the housing or on the housing, a cell storage provided on the housing for seating a cell, a luminance adjusting switch, and a controlling circuit board provided in the housing; the cell storage, the luminance adjusting switch, the controlling circuit board and the micro-current LED light source constituting a series connection circuit. The sighting device is characterized in: a solar cell is provided on the housing; the solar cell supplies power for the micro-current LED light source by connecting with the micro-current LED light source through a conducting wire; the sighting device further comprises a dual-power supply automatic switching module provided in the housing, for conducting an electrical connection between the solar cell and the micro-current LED light source when the luminance adjusting switch is in a turn-off state, such that the solar cell supplies power for the micro-current LED light source; or conducting the series connection circuit constituted by the cell, the luminance adjusting switch, the controlling circuit board and the inner micro-current LED light source when the solar cell cannot provide sufficient voltage or current, achieving a power supply for the micro-current LED light source by the cell, and a luminance control for the output light from the micro-current LED light source by the luminance adjusting switch.

A trigger switch is further provided on the above-mentioned housing; after receiving a input signal from the trigger switch, the dual-power supply automatic switching module breaks the electrical connection between the solar cell and the micro-current LED light source as well as conducts the series connection circuit constituted by the cell, the luminance adjusting switch, the controlling circuit board and the micro-current LED light source synchronously; the trigger switch is in series connection between the cell and the dual-power supply automatic switching module.

The above-mentioned luminance adjusting switch is a buttoned switch comprising "+" and "−" buttons; on the controlling circuit board there is comprised a processing chip MCU and a stage controlling circuit;

The solar cell is connected to the micro-current LED light source in series via the processing chip MCU; the cell is connected to the micro-current LED light source in series via the processing chip MCU and the stage controlling circuit; the "+" and "−" buttons are connected with the processing chip MCU, respectively;

The processing chip MCU breaks the electrical connection between the solar cell and the micro-current LED light source according to a preliminary input signal from any one of the "+" and "−" buttons, and controls the stage controlling circuit according to a secondary or repeated input signal from any one of the "+" and "−" buttons, so as to achieve an adjustment to the a voltage or current supplied for the micro-current LED light source, changing the luminance of the light emitted from the micro-current LED light source; and breaks the electrical connection between the cell and the stage controlling circuit as well as recovers the electrical connection between the solar cell and the micro-current LED light source synchronously according to the signals inputted simultaneously from the "+" and buttons or no signals inputted in a period of time.

The above-mentioned inner red-dot gun sighting device powered by a solar cell and provided with a micro-current LED light source, further comprises an arched lens support on a front end of the housing for mounting a lens, and a controlling circuit board in the housing; the cell storage, the luminance adjusting switch, the controlling circuit board and the micro-current LED light source constituted a series connection circuit; the micro-current LED light source is mounted at a rear end of the housing; the cell storage is imbed-mounted at a top surface of the housing, and disposed between the cell storage and the micro-current LED light source; the "+" and "−" buttons are provided at rear ends of a left surface and a right surface of the housing, respectively.

The above-mentioned micro-current LED light source is mounted on a slide which is disposed in a rear end of the housing and is laterally movable in a left and right direction along the housing; the slide has a "工" shaped cross-section; on a top portion of its front end surface there is provided with a micro-current LED light source seating groove, and the top portion is provided with a limiting sliding groove cooperating with a limiting slide extending downwards from an inner surface of the top surface of the housing.

A lower cover located under the slide is provided on the bottom surface of the above-mentioned housing, and four three fixing screw holes and at least one draining hole are provided on the lower cover.

A left trapped rail and a right trapped rail that extend axially are provided on the bottom surface of the housing; a dovetail block (19) is provided on the left trapped rail, and is threadingly coupled with a locking screw penetrated from the right trapped rail; the housing is coupled with a barrel coupling sleeve through the left trapped rail and the right trapped rail; the barrel coupling sleeve is constituted by a supporting tube with an axial duct provided therein, and a case nested thereoutside; the supporting tube comprises a quadrangular prism and a circular end surface provided at a front end of the quadrangular prism; a axially extending limiting beam is provided on each bottom end of a left and a right surfaces of the quadrangular prism; a sliding groove extending axially and protruding downwards beyond the bottom surface is provided at a bottom surface of the quadrangular prism; a fixing trapped rail axially extending backwards from the circular end surface and clamped by the left trapped rail and the right trapped rail is provided at the front end of a top surface of the quadrangular prism; a first screw hole penetrating the axial duct is provided behind the fixing trapped rail; an axially extending hole groove for insertion of the left trapped rail and the right trapped rail is provided at a front end of a top surface of the case; an axially extending elongated groove is at the top surface of the case behind the hole groove; and a second screw hole is provided on the elongated groove; a downward protruding chamber for accommodating the sliding groove is provided at the front end of the bottom surface of the case; the downward protruding chamber is coupled with the sliding groove by a screw.

The above-mentioned axial duct has an inner diameter decreasing gradually from a front end to a rear end of the supporting tube; the rear end of the case has a truncated cone shape which becomes thinner gradually from front to rear.

A horizontal adjusting screw is mounted on the above-mentioned housing on its right surface at a place corresponding to the slide; an adjusting coil spring is mounted between the left surface of the housing and the slide; the adjusting coil spring is nested on the limiting column. an opening stop-collar that snapped and nested on the horizontal adjusting screw is provided in the housing, so as to prevent the horizontal adjusting screw from rotating due to the squeezing of the adjusting coil spring.

In a rear end surface of the above-mentioned housing there are provided a boost pin that presses against a rear end surface of the slide, a boost coil spring nested on the boost pin, and a fixing screw threadingly coupled with the housing and presses against a rear end of the boost coil spring; the boost coil spring and fixing screw can achieve a front-rear limiting for the slide by means of the boost pin. An up and down adjusting screw is provided perpendicularly at a rear end of the housing, which is threadingly coupled with the adjusting disc provided in the rear end of the housing and imbed-coupled with the rear end surface of the slide.

The above-mentioned solar cell is imbed-mounted at a top surface of the housing, and a protection glass is provided at a top surface of the solar cell. The solar cell is any one of a monocrystalline silicon, a polycrystalline silicon, a silicon photodiode or a low-light amorphous silicon solar cell. The luminance adjusting switch is a buttoned switch comprising "+" and "−" buttons, and are provided at both sides of the front end of the housing, respectively.

The advantages of the present invention lie in: by using the solar cell to supply power for the micro-current LED light source, it is possible for the inner red-dot gun sighting device itself to automatically adjust the luminance of the output light from the micro-current LED light source as the environment luminance changes, without relying on any controlling circuit. The normal working power of the sighting device can be ensured in the case of no cell, which can reduce the use to the cell, prolong the lifetime of the cell, and decrease the using cost. Taking the cell power system of the inner red-dot sighting device or other LED light source themselves, the normal use of the inner red-dot sighting device or other LED light source during at night can be ensured.

Hereinafter, further description will be made in combination with the drawings and embodiment, which is not intend to limit the scope of the present invention.

EXPLANATIONS TO THE REFERENCE SIGNS

1, housing; 2, solar cell; 3, trigger switch; 4, 5, "+", "−" button; 6, micro-current LED light source; 7, cell storage; 8, trapped rail; 9, lens; 10, arched lens support; 11, luminance adjusting switch; 12, slide; 13, micro-current LED light source seating groove; 14, limiting slide; 15, limiting slide groove; 16, lower cover; 17, fixing screw hole; 18, draining hole; 19, dovetail block; 20, locking screw; 21, supporting tube; 22, case; 23, quadrangular prism; 24, circular end surface; 25, 26, limiting beam; 27, sliding groove; 28, fixing trapped rail; 29, first screw hole; 30, hole groove; 31, elongated groove; 32, second screw hole; 33, downward protruding chamber; 34, horizontal adjusting screw; 35, adjusting coil spring; 36, limiting column; 37, opening stop-collar; 38, boost pin; 39, boost coil spring; 40, fixing screw; 41, up and down adjusting screw; 42, adjusting disc; 43, axial duct; 44, protruding collar; 45, circuit board; 46, protection glass; 47, cell cover; 48, cell; 49, cell washer; 50, front cover; 51, LED protection glass; 52, screw.

DETAILED DESCRIPTION

Figure 1:
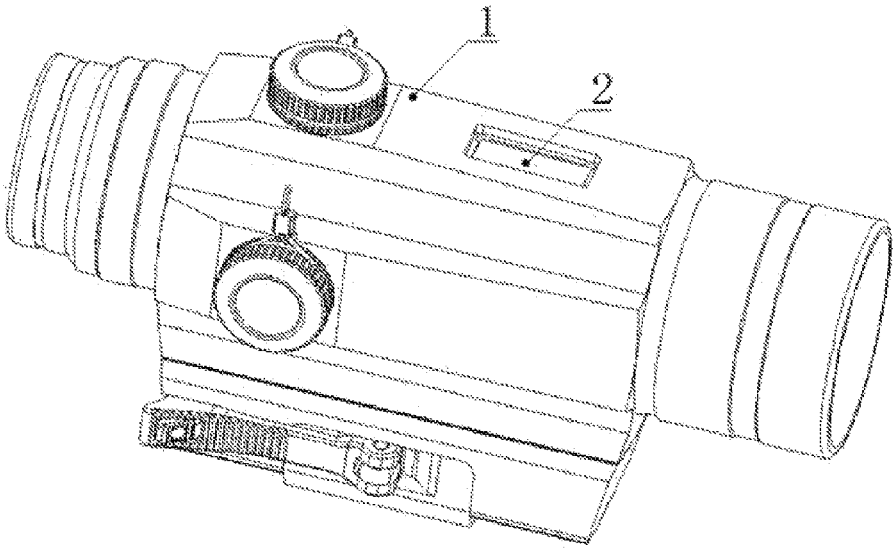
FIG. 1 is a schematic perspective view of a solar inner red-dot sighting device without a luminance adjusting switch.
Figure 3:
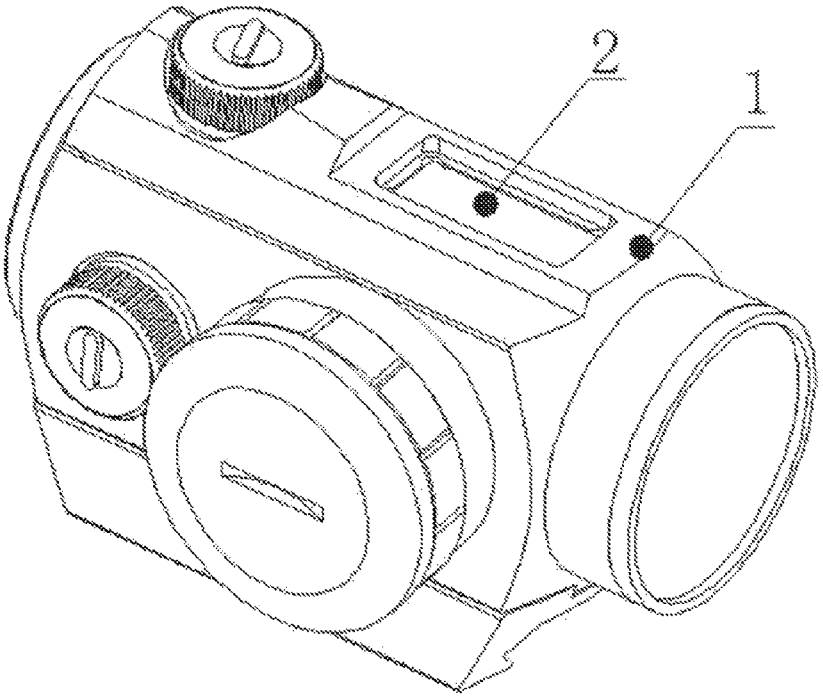
FIG. 3 is a schematic perspective view of a solar inner red-dot sighting device provided with a knobbed luminance adjusting switch and a cell storage.
Figure 4:
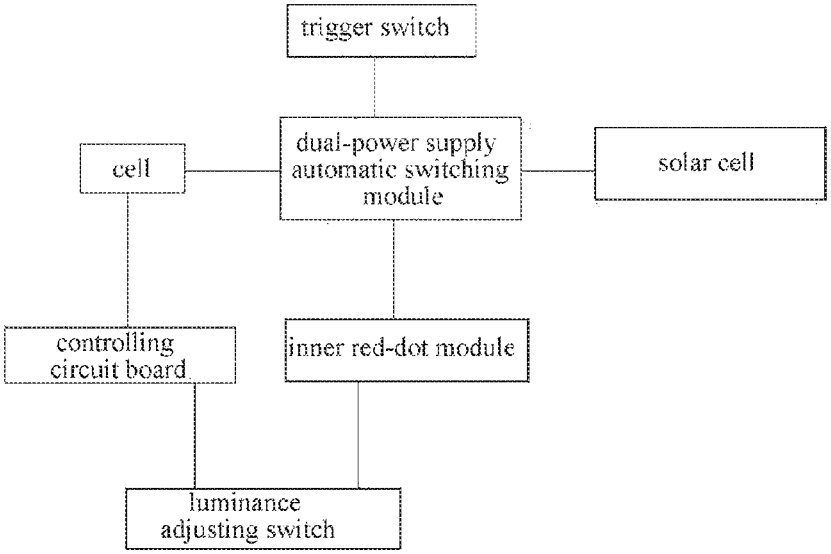
FIG. 4 is a schematic perspective view of a solar inner red-dot sighting device provided with a dual-power supply automatic switching module therein.
Figure 5:
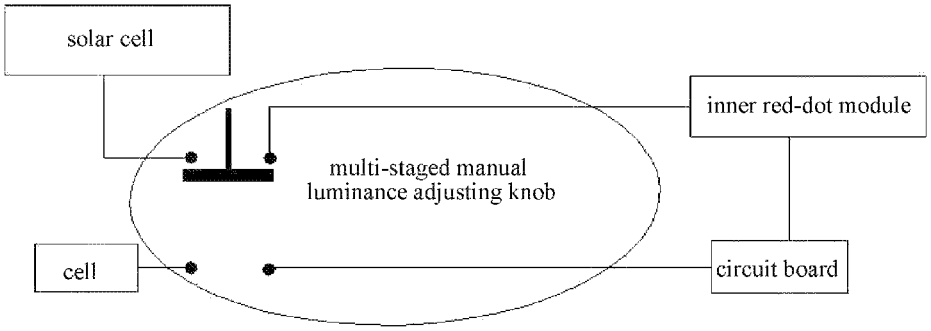
FIG. 5 is a schematic perspective view of a solar inner red-dot sighting device adopting a multi-staged manual luminance adjusting knob.

Embodiment 1, an inner red-dot sighting device powered by a solar cell, wherein an inner red-dot module without a luminance adjusting switch is mounted on a LED mounting support inside a housing: as shown by FIGS. 1, 4 (an inner red-dot sighting device without a luminance adjusting switch), includes a housing 1, an inner red-dot module (using a micro-current LED as a light source) provided on the housing 1, a cell provided inside the housing 1 (a cell storage in the knob switch is provided at a side surface of the housing of the inner red-dot sighting device shown by FIG. 3), a luminance adjusting switch provided on the housing 1, a controlling circuit board provided in the housing 1; the cell, the luminance adjusting switch, the controlling circuit board and the inner red-dot module (using the micro-current LED as the light source) constituting a series connection circuit. Particularly, the sighting device further comprises a solar sell 2 provided on the housing 1, and a dual-power supply automatic switching module (of course, a multi-staged manual luminance adjusting knob as shown by FIG. 5 may be adopted, for achieving manual switching of power) provided in the housing 1, for conducting an electrical connection between the solar cell 2 and the inner red-dot light source (using a micro-current LED as a light source) when the luminance adjusting switch is in a turn-off state, such that the solar cell 2 supplies power for the inner red-dot module (using the micro-current LED as the light source); or conducting the series connection circuit constituted by the cell, the luminance adjusting switch, the controlling circuit board and the inner red-dot module (using the micro-current LED as the light source) when the solar cell 2 cannot provide sufficient voltage or current, achieving a power supply for inner red-dot module (using the micro-current LED as the light source) by the cell, and a luminance control for the output light from the inner red-dot module (using the micro-current LED as the light source) by the luminance adjusting switch.

By adding the solar cell and the dual-power supply automatic switching module (switch), power supply for the inner red-dot module (using the micro-current LED as the light source) can be achieved by the solar cell in a sunny (daytime) environment, and the working power of the sighting device can be ensured without the cell. The cell is unnecessarily to be installed at the same time. The only requirement is to switch to the cell power supply by the dual-power supply automatic switching module when there is not enough sunshine or no sunshine (nighttime).

Figure 2:
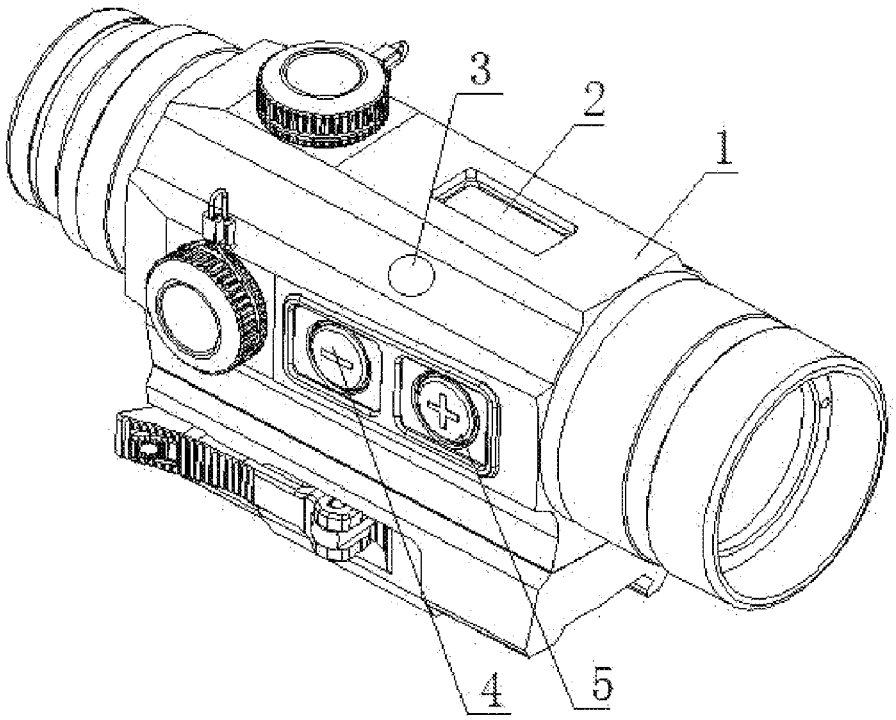
FIG. 2 is a schematic perspective view of a solar inner red-dot sighting device provided with a buttoned luminance adjusting switch and a cell storage.

When it is getting dark, by a trigger switch 3 provided on the housing 1 as shown by FIG. 2 in the present embodiment, an input signal is given to the dual-power supply automatic switching module, so as to achieve the manual power switching, i.e., the connection between the solar cell 2 and the inner red-dot module (using the micro-current LED as the light source) is broken, and the inner red-dot module (using the micro-current LED as the light source) is supplied with power by the cell. In other words, after the dual-power supply automatic switching module receiving the input signal from the trigger switch 4, the electrical connection between the solar cell 2 and the inner red-dot module (using the micro-current LED as the light source) is broken, and the series connection circuit constituted by the cell, the luminance adjusting switch, the controlling circuit board and the inner red-dot module (using the micro-current LED as the light source) is conducted.

FIG. 2 shows an inner red-dot sighting device schematic perspective view, wherein an outside wall of the housing 1 is provided with a luminance adjusting switch. As seen in this figure, the luminance adjusting switch is a buttoned switch, including the "+" and "−" buttons 4, 5 as shown in FIG. 1.

The solar cell 2 provided in the present embodiment is shown in FIG. 1, which is imbed-mounted at a top surface of the housing 1 (of course, it may be mounted as required), to help the low-light amorphous silicon solar cell 2 to receive the sunshine in longest time and largest area, so as to provide a sufficient and durable power, ensuring the best performance of the low-light amorphous silicon solar cell 2. Further, a protection glass is provided at the top surface of the solar cell 2 的 top surface, to avoid a deposited dust and an accidental scratching to the low-light amorphous silicon solar cell.

In this way, when the solar-powered inner red-dot sighting device according to the present embodiment is used in the daytime or sunny environment, in the premise of no input signal from the trigger switch 3, the dual-power supply automatic switching module conducts the electrical connection between the solar cell 2 and the inner red-dot module (using the micro-current LED as the light source), such that inner red-dot module (using the micro-current LED as the light source) is powered by the solar cell 2, and the luminance of the light emitted from the micro-current LED light source will adaptively changes according to the power generated by the solar cell 2. For example, when the environment luminance increases, the luminance of the light emitted from the inner red-dot module (using the micro-current LED as the light source) will increase. In the contrary, when the environment luminance becomes dark and weak, and the solar cell 2 cannot provide sufficient voltage or current, the dual-power supply automatic switching module will break the connection between the solar cell 2 and the inner red-dot module (using the micro-current LED as the light source), and switch to the cell power supply. Of course, in the premise that when the solar cell provides a relatively small voltage or current, but not so small to cause the switch of the dual-power supply automatic switching module, and at this time the output laser from micro-current LED light source is dark, a input signal may be manually give to the dual-power supply automatic switching module by the trigger switch 3, to break the connection between the solar cell 2 and the inner red-dot module (using the micro-current LED as the light source), and conduct the connection circuit for the cell and the inner red-dot module (using the micro-current LED as the light source). The solar cell 2 mentioned in the present embodiment may be any one of a monocrystalline silicon, a polycrystalline silicon, a silicon photodiode or a low-light amorphous silicon solar cell.

Figure 6:
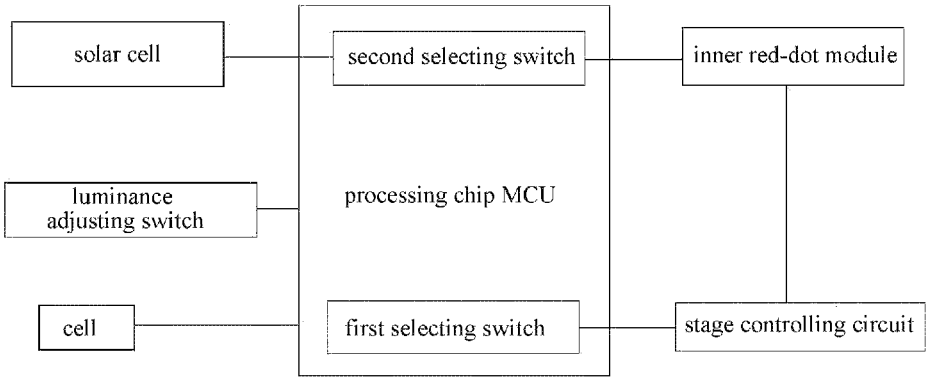
FIG. 6 is a schematic perspective view of a solar inner red-dot sighting device relying on a chip control to change a power source.

Embodiment 2: When a cell storage is provided at the bottom of the inner red-dot sighting device as shown by FIG. 2, the solar cell is in series connection with the micro-current LED light source via the processing chip MCU, and the cell in series connection with the micro-current LED light source via the processing chip MCU and the stage controlling circuit; the luminance adjusting switch is a buttoned switch, including "+" and "−" buttons; the "+" and "−" buttons 4, 5 are connected with the processing chip MCU, respectively; the processing chip MCU breaks the electrical connection between the solar cell and the micro-current LED light source according to a preliminary input signal from any one of the "+" and "−" buttons 4, 5, and controls the stage controlling circuit according to a secondary or repeated input signal from any one of the "+" and "−" buttons 4, 5, so as to achieve an adjustment to the a voltage or current supplied for the micro-current LED light source, changing the luminance of the light emitted from the micro-current LED light source; and breaks the electrical connection between the cell and the stage controlling circuit as well as recovers the electrical connection between the solar cell and the micro-current LED light source synchronously according to signals inputted simultaneously from the "+" and "−" buttons 4, 5 or no signals inputted in a period of time. As seen in combination with FIG. 6, in the processing chip MCU there are edited a second selecting switch, which is controlled by the processing chip MCU and conducts or breaks the electrical connection between the solar cell and the inner red-dot module; and a first switch, which conduct or breaks the electrical connection between the stage controlling circuit and the processing chip MCU according to the control of the processing chip MCU, so as to break or conduct the power circuit for the inner red-dot module.

Figure 7:
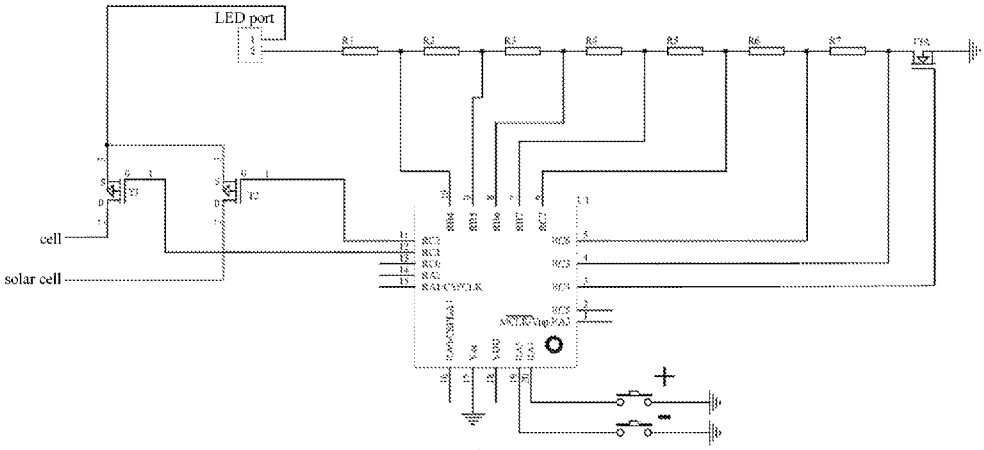
FIG. 7 is a schematic diagram of a control circuit, in which a power source change is achieved by a control chip.
Figure 8:
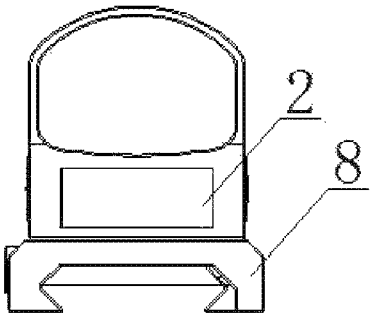
FIG. 8 is a schematic view of an in inner red-dot sighting device, in which an inner red-dot module is provided on a rear end of a top of a housing.

Further, an electronic circuit diagram of the solar powered inner red-dot sighting device according to the present embodiment is shown in FIG. 7, wherein U1 is the processing chip MCU, and the "+", "−" buttons 4, 5, which are buttoned switches, are respectively connected with the pins 19, 20 of the processing chip MCU, for inputting a trigger signal or a luminance adjusting signal to the processing chip MCU, such that the processing chip MCU controls the conduct and break of the first selecting switch T3 or the second selecting switch (which is a combined switch formed by MOS tubes T1 and T2) according to the input signal from the "+" and "−" buttons 4, 5, so as to switch the power source for the inner red-dot module, i.e., the LED port as shown in FIG. 3 (the emitting element in the inner red-dot module is a light emitting diode LED), that is, the power is supplied by the solar cell or the cell. Then, according to the input signal from any one of the "+" and "−" buttons 4, 5 that is inputted once again or in any number of times, the value of the electrical resistance of the stage controlling circuit that is in series connection in the working circuit is controlled, so as to change the value of the powered voltage or current for the inner red-dot module, i.e., at the port of the LED, achieving the adjustment to the output luminance of the inner red-dot module. Wherein, the stage controlling circuit is constituted by a plurality of resistors R1, R2, R3, R4, R5, R6, R7 connected in series, i.e., connected in series between the LED port and the negative potential, as shown by FIG. 3, the first selecting switch T3, the processing chip MCU connecting the adjacent resistors and nodes, and controlling wires of the resistor R7, the node of the first selecting switch T3 and the processing chip MCU. These controlling wires are connected with the pins 10, 9, 8, 7, 6, 5, 4 of the processing chip MCU, respectively. By controlling the voltages of these pins, the processing chip MCU achieve the amount of the series resistor between the LED port and the first selecting switch T3, achieve the changes to the voltage or current at the LED port, and finally achieves the adjustment to the luminance of the light emitted from the inner red-dot module. And the conduct and break of the first selecting switch T3 is controlled by the voltages at the pins 4 and 3 that connected with the first selecting switch T3.

Of course, as can be seen from FIG. 7, the second selecting switch is a combined switch constituted by MOS tubes T1 and T2 (the G poles of the MOS tubes T1 and T2 are respectively connected with the pins 11 and 12 of U1, and each of the S and D poles thereof are connected with the LED port, the cell or the solar cell). By using the processing chip MCU to control the conduct and break of the MOS tubes T1 and T2, achieving the conduct and break of the cell, or the solar cell and the LED port. That is, the MOS tube T1 has a state opposite to that of the MOS tub T2. When the MOS tube T1 is conducted or broken, the MOS tube T2 is in the broken or conducted state. In this way, when using the solar powered inner red-dot sighting device according to the present embodiment in daytime or sunny environment, in the premise of no input signal from any one of the "+" and "−" buttons 4, 5, the processing chip MCU breaks the power of the stage controlling circuit, and conducts the electrical connection between the solar cell 2 and the inner red-dot module (using the micro-current LED as the light source). The inner red-dot module (using the micro-current LED as the light source) is powered by the solar cell 2, and the luminance of the light emitted from the inner red-dot module (using the micro-current LED as the light source) will change adaptively as the power generated by the solar cell 2 changes. For example, when the environment luminance increases, the luminance of the light emitted from the inner red-dot module (using the micro-current LED as the light source) will follow and become lighter. In the contrary, it will become darker and decrease to follow the environment luminance without human operates, which is very convenience. More important, the cell and corresponding controlling circuit for powering the inner red-dot module (using the micro-current LED as the light source) are no longer need, and the cost caused by the replacement of the cells can thus be saved.

When the solar powered inner red-dot sighting device according to the present embodiment is used at night, if any one of the "+" and "−" buttons 4, 5 is pressed, an input signal will be given to the processing chip MCU, and the electrical connection between the solar cell 2 and the inner red-dot sighting device can be break. At the same time, the power circuit of the stage controlling circuit can be conducted, cell and the inner red-dot module (using the micro-current LED as the light source) will be powered by the cell. When the input signal of any one of the "+" and "−" buttons 4, 5 is inputted again or repeatedly, the value of the voltage or current supplied for the inner red-dot module (using the micro-current LED as the light source) can be adjusted, and luminance of the light output from the inner red-dot module (using the micro-current LED as the light source) can be adjusted to increase or decrease. To recover the solar cell power, it is only required that the input signals of the "+" and "−" buttons 4, 5 are inputted simultaneously, or there is no input signals in a period of time. The processing chip MCU breaks the electrical connection between the cell and the stage controlling circuit as well as recover the electrical connection between the solar cell and the inner red-dot module synchronously (using the micro-current LED as the light source).

Figure 9:
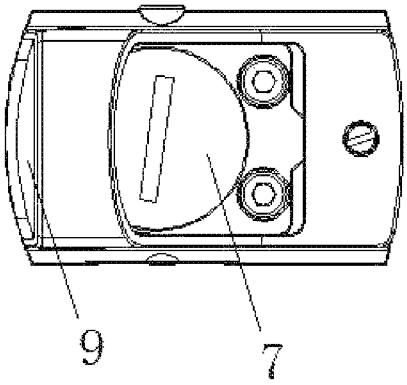
FIG. 9 is a top view of an inner red-dot sighting device, in which an inner red-dot module is provided on a rear end of a top of a housing.
Figure 10:
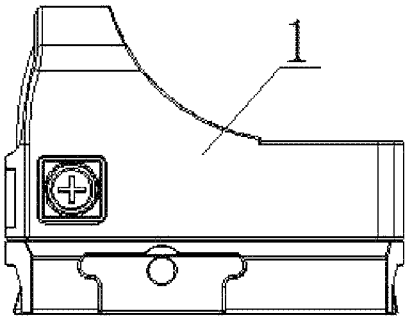
FIG. 10 is a schematic side view of an inner red-dot sighting device, in which an inner red-dot module is provided on a rear end of a top of a housing.

In the above embodiments, the solar cell 2 is mounted at a top surface of the housing 1, which is intend to ensure a largest light receiving area for the solar cell 2, and to use its full performance. Of course, according to the actual structure and requirement of the inner red-dot sighting device, the solar cell 2 may also be provided at an end surface of the front end of the housing 1 of the inner red-dot sighting device, as shown in FIG. 9 (the LED light source is mounted at the top surface of a rear end of the housing 1; the cell storage is provided at the top surface of the housing 1, and is disposed between the LED light source and a lens 9, see FIG. 9). As seen in FIG. 10, the luminance adjusting switch of the inner red-dot sighting device is a button, and its "+" and "–" buttons 4, 5 are mounted at the left and sight sides of the front end of the housing 1, respectively.

Figure 11:
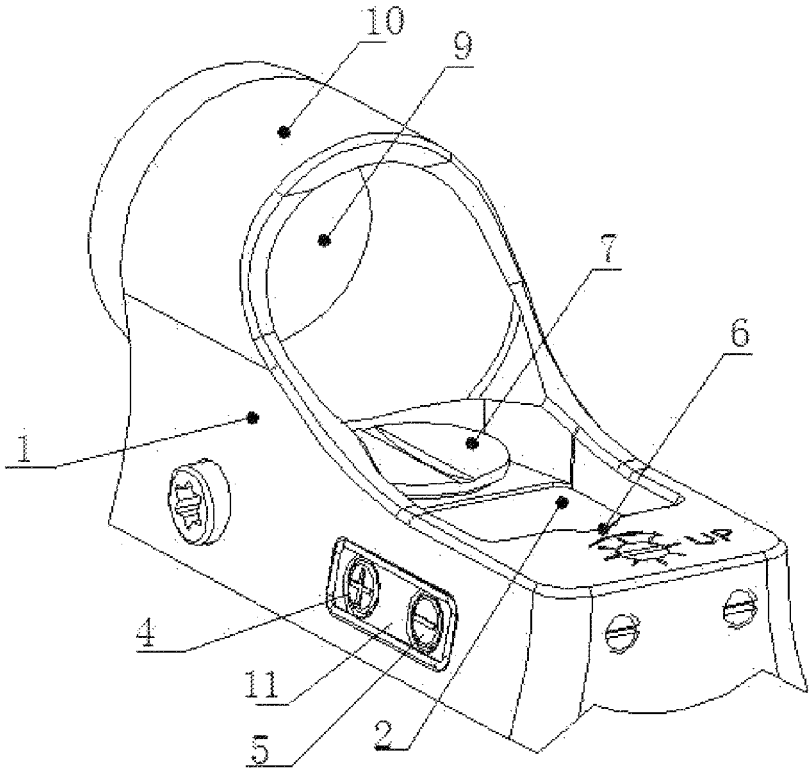
FIG. 11 is an isometric side view of a solar inner red-dot gun sighting device with a crosshair.
Figure 12:
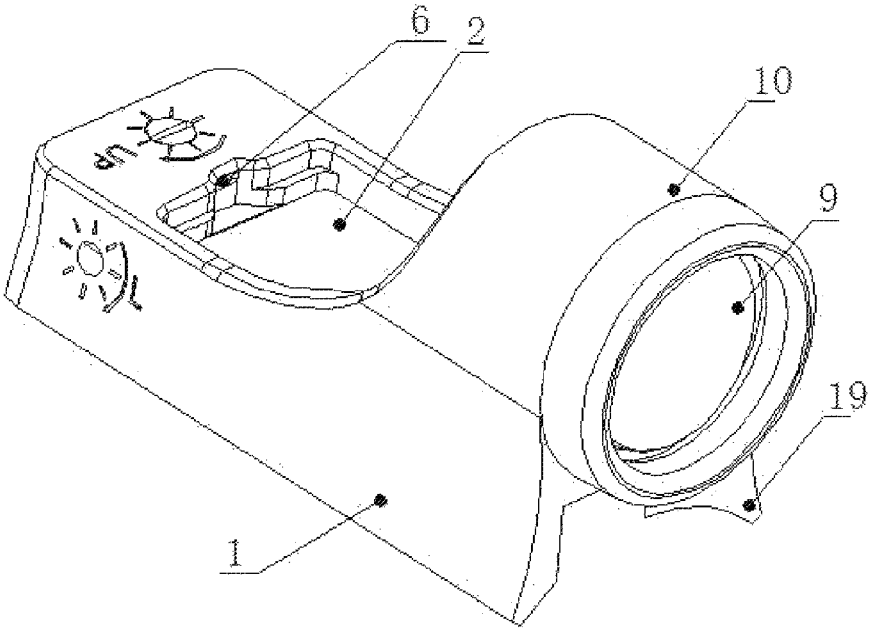
FIG. 12 is a left-front isometric side view of solar inner red-dot gun sighting device with a crosshair.

A solar inner red-dot gun sighting device with a crosshair is shown in FIGS. 11 and 12, comprising an arched lens support 10 for a lens 9 mounted at the front end of the housing 1, a cell storage 7 provided in the housing 1, a luminance adjusting switch 10 provided on the housing 1, a controlling circuit board provided in the housing 1; the cell storage 7, the luminance adjusting switch 11, the controlling circuit board and a micro-current LED light source 6 constitute a series connection circuit; the micro-current LED light source 6 is mounted at the rear end of the housing 1; the cell storage 7 is imbed-mounted at the top surface of the housing 1, and is provided between the cell storage 7 and the micro-current LED light source 6; the luminance adjusting switch 11 is a buttoned switch, comprising "+" and "–" buttons 4, 5 that are provided at the rear ends of the left and right surfaces of the housing 1, respectively.

Figure 13:
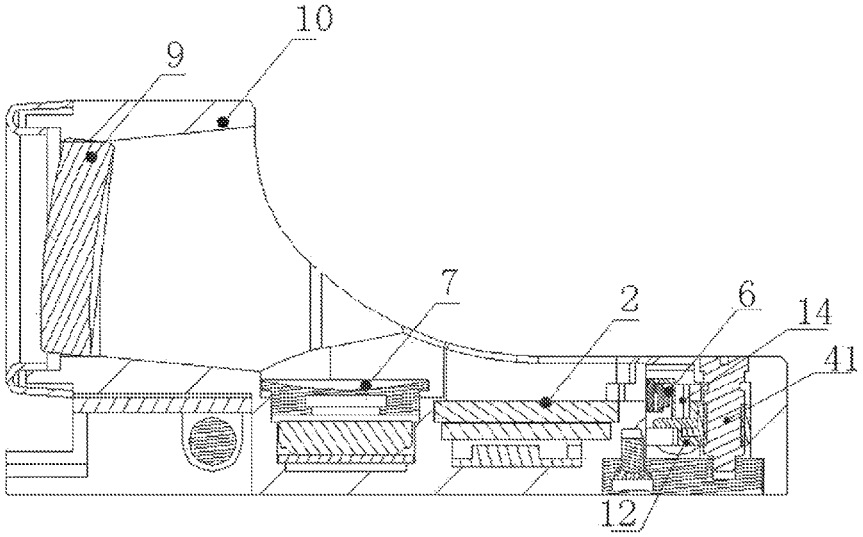
FIG. 13 is an axial cores-section view of a solar inner red-dot gun sighting device with a crosshair.

As seen in FIG. 13, the micro-current LED light source 6 is mounted on a slide 12 that is disposed in the rear end of the housing 1 and slidable left and right in the lateral direction of the housing 1. The slide 12 has a "工" shaped cross-section. A micro-current LED light source seating groove 13 is provided at a top portion of the front end surface of the slide 12. A limiting sliding groove 15, which cooperates with a limiting slide 14 extending downwards from an inner surface of the top surface of the housing 1, is provided at the top portion of slide 12. In this way, in combination with the arrangement as show in FIG. 16, a horizontal adjusting screw 34 is mounted at a place corresponding to the slide 12 on the right surface of the housing 1, and an adjusting coil spring 35 is mounted between the left surface of the housing 1 and the slide 12. The adjusting coil spring 35 is nested on a limiting column 36, and pushes inwardly or releases the pressure on the slide 12 by the forward or backward rotation of the horizontal adjusting screw 34. The slide 12 presses the adjusting coil spring 35 when under the push of the horizontal adjusting screw 34, or otherwise, is pushed oppositely by the adjusting coil spring 35, so as to achieve the lateral and horizontal movement of the slide 12, and finally achieves the adjustment to the lateral and horizontal position of the micro-current LED light source 6. In the process, the lateral adjusting range of the slide 12 is limited by the limiting slide 14 and the limiting sliding groove 15, preventing an exceed screwing or releasing of the horizontal adjusting screw 34, which would greatly influence the lateral position of the micro-current LED light source 6. The fine adjustment for the lateral position of the micro-current LED light source 6 is achieved, which helps to improve the adjusting accuracy.

Figure 14:
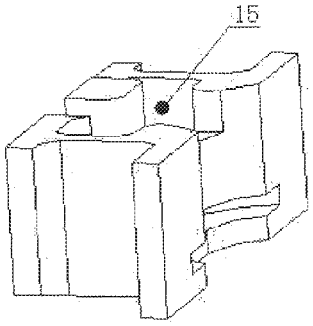
FIG. 14 is a perspective view of a slide schematic.
Figure 15:
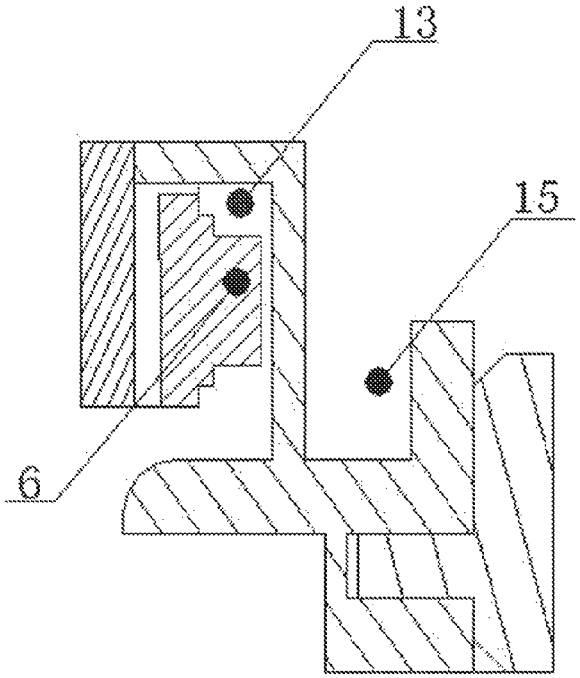
FIG. 15 is an axial cross-section view of a slide (mounted with a LED lamp and an adjusting disc).
Figure 16:
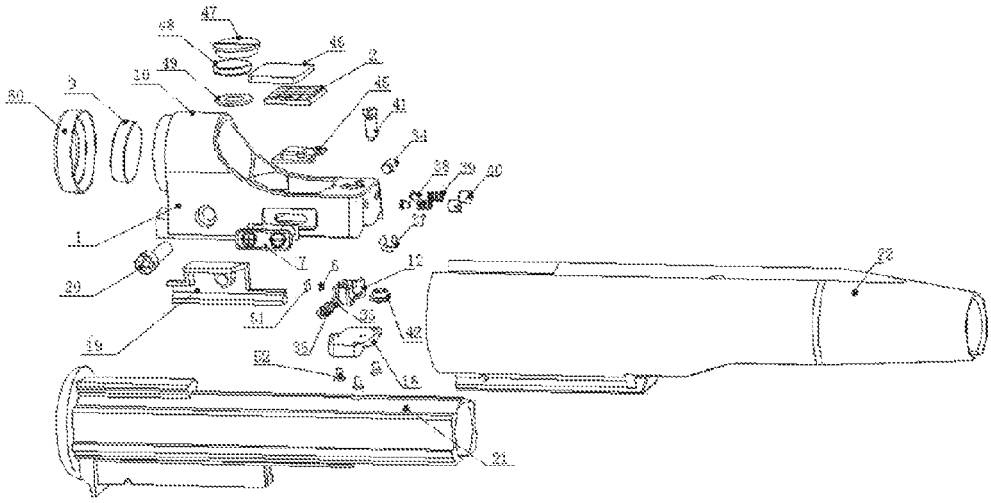
FIG. 16 is an explosive view of a solar inner red-dot gun sighting device with a crosshair.
Figure 17:
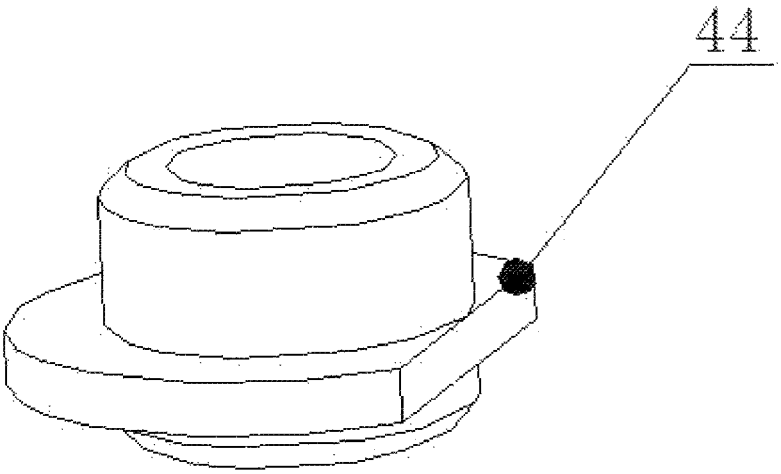
FIG. 17 is a perspective view of an adjusting disc.

To ensure the stability of the adjustment of the lateral and horizontal position for the slide 12, as shown in FIG. 16, in the rear end surface of the housing 1 there is provided with: a boost pin 38 that contacts and presses on a rear end surface of the slide 12, a boost coil spring 39 that is nested on the boost pin 38, and a fixing screw 40 that is threadingly coupled with the housing 1 and contacts and press on the rear end of the boost coil spring 39. A front-rear limitation to the slide 12 is achieved by the boost pin 38, the boost coil spring 39 and the fixing screw 40. To prevent the horizontal adjusting screw 34 from rotating under the pressure of the adjusting coil spring 35, an opening stop-collar 37 that nested on the horizontal adjusting screw 34 is provided in the housing 1 for this purpose. As seen in FIG. 13 or 16, an up and down adjusting screw 41 is provided perpendicularly at the rear end of the housing 1, which is threadingly coupled with an adjusting disc 42 that is provided in the rear end of the housing 1 and imbed-coupled with the rear end surface of the slide 12 (see FIG. 15, as seen in FIG. 14, a groove is provided at the bottom end of the rear end surface of the slide 12, so as to help a protruding collar 44 on the periphery wall of the adjusting disc 42 as shown in FIG. 17 to snap in).

Figure 18:
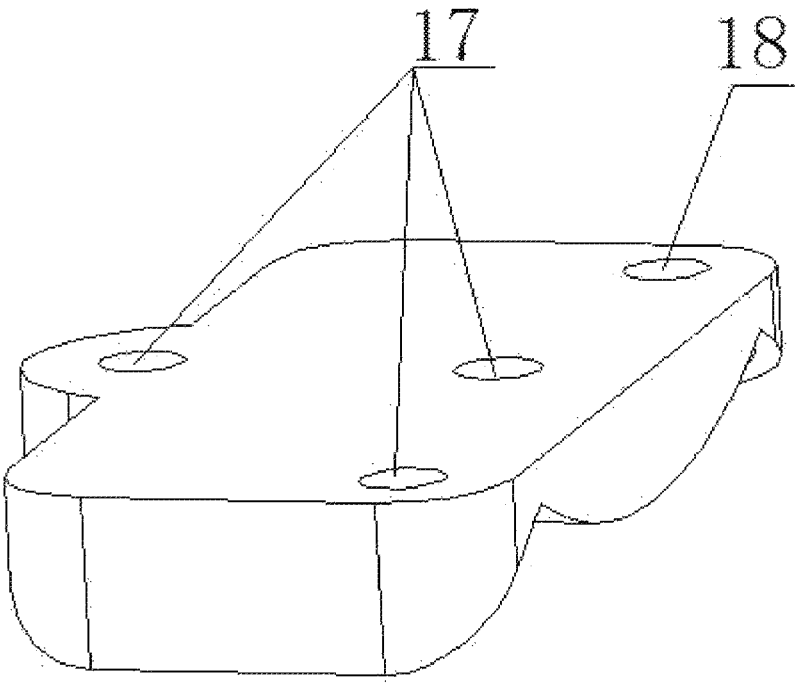
FIG. 18 is a schematic view of a lower cover structure.
Figure 19:
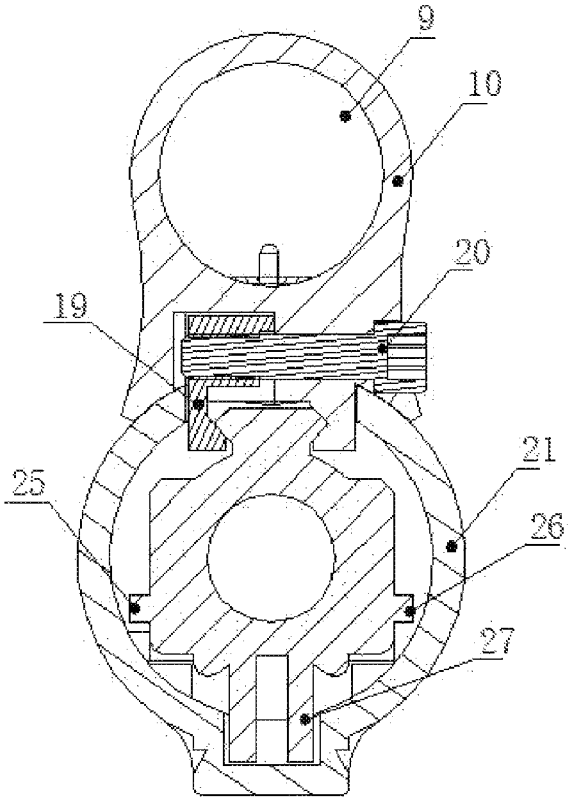
FIG. 19 is a lateral cross-section view (in left and right direction) of a solar inner red-dot gun sighting device with a crosshair.

Also, as seen in FIG. 16, a lower cover 16 positioned under the slide 12 is provided on the bottom surface of the housing 1. Take FIG. 18 in combination, the slide 12 is provided with three fixing screw holes 17 and at least one draining hole 18. To achieve the simple coupling between the gun and the solar inner red-dot gun sighting device with the crosshair according to the above embodiment, as seen on the base of FIG. 16 and take FIG. 19 in combination, a the left trapped rail and a right trapped rail extending axially are provided at the bottom surface of the housing 1. A dovetail block 19 is provided on the trapped rail, which is threadingly coupled with a locking screw 20 penetrated from the right trapped rail. The housing 1 is coupled with the barrel coupling sleeve by the left trapped rail and the right trapped rail. As shown in FIG. 16, the barrel coupling sleeve is constituted by an axial hollow supporting tube 21 and a case 22 nested outside thereof.

Figure 20:
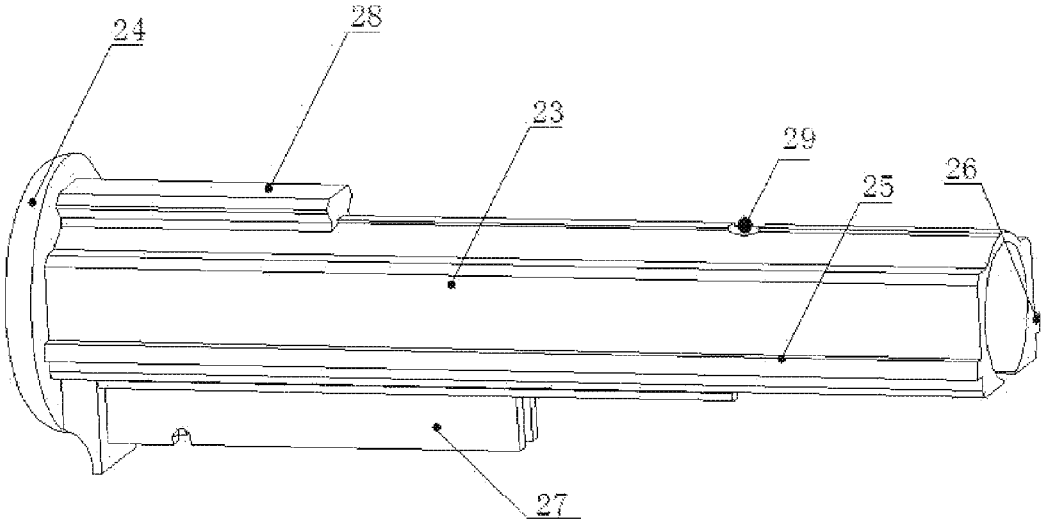
FIG. 20 is a schematic view of a supporting tube.
Figure 21:
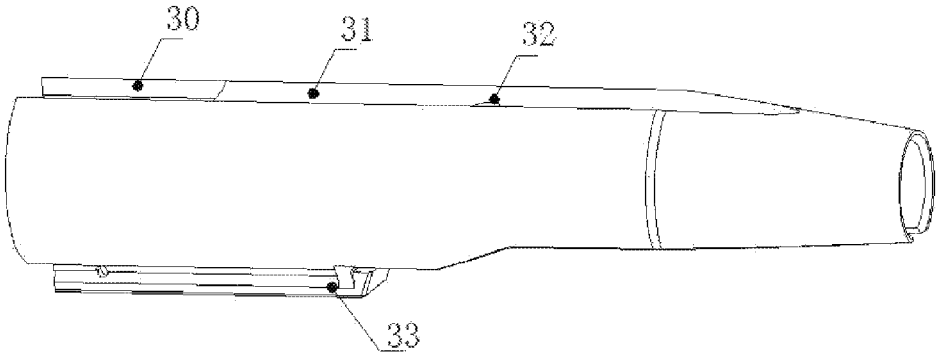
FIG. 21 is a schematic view of a case.
Figure 22:
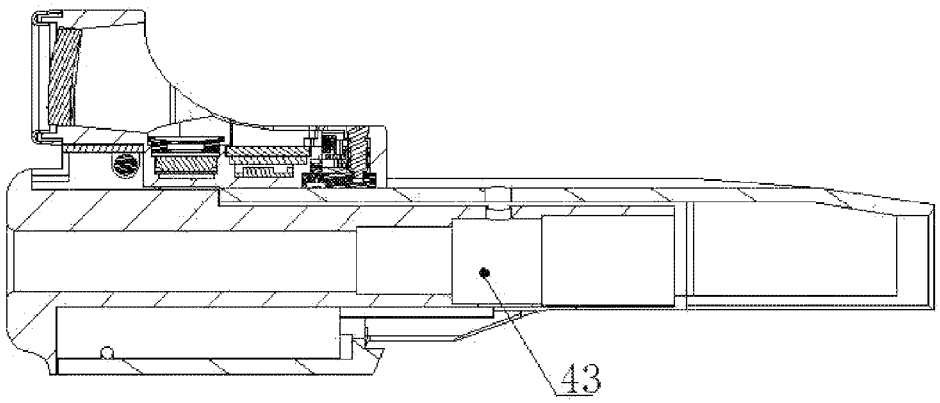
FIG. 22 is an axial cross-section view of a solar inner red-dot gun sighting device with a crosshair mounted with a barrel coupling sleeve.

As shown in FIG. 20, the supporting tube 21 comprises a quadrangular prism 23 and a circular end surface 24 provided at a front end of the quadrangular prism 23. An axially extending limiting beam 25, 26 is provided at each bottom end of a left and a right surfaces of the quadrangular prism 23, respectively. A sliding groove 27 extending axially and protruding downwards beyond the bottom surface is provided at a bottom surface of the quadrangular prism 23. A fixing trapped rail 28 axially extending backwards from the circular end surface 24 and clamped by the left trapped rail and the right trapped rail is provided at a front end of a top surface of the quadrangular prism 23. A first screw hole 29 penetrating the axial duct 43 as shown in FIG. 22 is provided behind the fixing trapped rail. As shown in FIG. 21, an axially extending hole groove 30 for insertion of the left trapped rail and the right trapped rail is provided at a front end of a top surface of the case 22. An axially extending elongated groove 31 is at a top surface of a case 22 behind the hole groove 30, and a second screw hole 32 is provided on the elongated groove 31. A downward protruding chamber 33 for accommodating the sliding groove 27 is provided at the front end of the bottom surface of the case 22. The downward protruding chamber 33 is coupled with the sliding groove 27 by a screw 52.

After the case 22 is nested on the supporting tube 21, a screw coupling is adapted by the first screw hole 29 and the second screw hole 32. The solar inner red-dot gun sighting device with the crosshair, after being inserted into the hole groove 30 by the left trapped rail and the right trapped rail provided on the bottom surface of its housing 1, achieves a clamp coupling between the left trapped rail and the right trapped rail and the fixing trapped rail 28 by means of the dovetail block 19 and the locking screw 20, then the supporting tube 21, as well as the entire solar inner red-dot gun sighting device with the crosshair is nested on the gun barrel, and is finally limited by the connection screw passing through the first screw hole 29 and the second screw hole 32, which has a convenient assembling and disassembling. As shown in FIG. 22, circumferential extending axial duct 43 of the supporting tube 21 has an inner diameter decreasing gradually from a front end to a rear end of the supporting tube 21. Such structure actually achieves the mounting limit for the entire solar inner red-dot gun sighting device with the crosshair.

The rear end of the case 22 has a truncated cone shape which becomes thinner gradually from front to rear, which can reduce the obstruct of the case 22 to the human sight. Also, as seen in FIG. 16, the solar inner red-dot gun sighting device with the crosshair according to the above embodiments is further provided with a protection glass for the sola cell 2, to prevent the solar cell from damage. At the same time, a cell cover 47 is provided outside the cell 48, and a cell washer 49, which is an elastic member for tightly pressing the cell 48 in cooperation with the cell cover 47, is provided at the bottom of the cell 48. Likewise, a LED protection glass 46 is provided outside the micro-current LED light source 6. The screw 52 as shown in FIG. 16 is used to achieve the connection between the lower cover 16 and the housing 1.

In view of the above, it can be easily seen that, by using the solar cell 2 to supply power for the micro-current LED light source 6, it is possible for the inner red-dot gun sighting device itself to automatically adjust the luminance of the output light from the micro-current LED light source as the environment luminance changes, without relying on any controlling circuit. That is, the normal working power of the sighting device can be ensured in the case of no cell, which can reduce the use to the cell, prolong the lifetime of the cell, and decrease the using cost. Further, by means of the left trapped rail and the right trapped rail mounted at the bottom of the gun sighting device and the barrel coupling sleeve to be coupled with the barrel, the gun sighting device can be used very conveniently.

What is claimed is:

1. An inner red-dot gun sighting device powered by a solar cell and provided with a micro-current LED light source, comprising a housing (1), a micro-current LED light source (6) provided in the housing (1) or on the housing (1), a cell storage (7) provided on the housing (1) for seating a cell, a luminance adjusting switch, and a controlling circuit board provided in the housing (1); the cell storage, the luminance adjusting switch (11), the controlling circuit board and the micro-current LED light source (6) constituting a series connection circuit, wherein a solar cell (2) is provided on the housing (1); the solar cell (2) supplies power for the micro-current LED light source (6) by connecting with the micro-current LED light source through a conducting wire;

the sighting device further comprises a dual-power supply automatic switching module provided in the housing (1), for conducting an electrical connection between the solar cell (2) and the micro-current LED light source (6) when the luminance adjusting switch is in a turn-off state, such that the solar cell (2) supplies power for the micro-current LED light source (6); or conducting the series connection circuit constituted by the cell, the luminance adjusting switch, the controlling circuit board and the inner micro-current LED light source (6) when the solar cell (2) cannot provide sufficient voltage or current, achieving a power supply for the micro-current LED light source (6) by the cell, and a luminance control for the output light from the micro-current LED light source (6) by the luminance adjusting switch, wherein the luminance adjusting switch is a buttoned switch (11) comprising "+" and "−" buttons (4, 5), wherein the controlling circuit board is provided thereon with a processing chip MCU and a stage controlling circuit;

the solar cell (2) is connected to the micro-current LED light source (6) in series via the processing chip MCU, the cell is connected to the micro-current LED) light source (6) in series via the processing chip MCU and the stage controlling circuit: the "+" and "−" buttons (4, 5) are connected with the processing chip MCU respectively, the processing chip MCU breaks the electrical connection between the solar cell (2) and the micro-current LED light source (6) according to a preliminary input signal from any one of the "+" and "−" buttons (4, 5), and controls the stage controlling circuit according to a secondary or repeated input signal from any one of the "+" and "−" buttons (4, 5), so as to achieve an adjustment to the a voltage or current supplied for the micro-current LED light source (6), changing the luminance of the light emitted from the micro-current LED light source (6); and breaks the electrical connection between the cell and the stage controlling circuit as well as recovers the electrical connection between the solar cell (2) and the micro-current LED light source (6) synchronously according to signals inputted simultaneously from the "+" and "−" buttons (4, 5) or no signals inputted in a period of time.

2. The inner red-dot gun sighting device powered by the solar cell and provided with the micro-current LED light source according to claim 1, wherein a trigger switch (3) is further provided on the housing (1); after receiving a input signal from the trigger switch (3), the dual-power supply automatic switching module breaks the electrical connection between the solar cell (2) and the micro-current LED light source (6) as well as conducts the series connection circuit constituted by the cell, the luminance adjusting switch, the controlling circuit board and the micro-current LED light source (6) synchronously;

the trigger switch (3) is in series connection between the cell and the dual-power supply automatic switching module.

3. The inner red-dot gun sighting device powered by the solar cell and provided with the micro-current LED light source according to claim 2, wherein the solar cell (2) is imbed-mounted at a top surface or an end surface of the front end of the housing (1), and a protection glass is provided at a top surface of the solar cell (2).

4. The inner red-dot gun sighting device powered by the solar cell and provided with the micro-current LED light source according to claim 1, wherein the sighting device further comprises an arched lens support (10) provided on a front end of the housing (1) for mounting a lens (9), and a controlling circuit board provided in the housing (1); the cell storage (7), the luminance adjusting switch (11), the controlling circuit board and the micro-current LED light source (6) constitute a series connection circuit; the micro-current LED light source (6) is mounted at a rear end of the housing (1); the cell storage (7) is imbed-mounted at a top surface of the housing (1), and the solar cell (2) is disposed between the cell storage (7) and the micro-current LED light source (6), the "+" and "−" buttons (4, 5) are provided at rear ends of a left surface and a right surface of the housing (1), respectively.

5. The inner red-dot gun sighting device with a crosshair according to claim 4, wherein the micro-current LED light source (6) is mounted on a slide (12) which is disposed in a rear end of the housing (1) and is laterally movable in a left and right direction along the housing (1); the slide (12) has a "工" shaped cross-section, on a top portion of its front end surface there is provided with a micro-current LED light source seating groove (13), and the top portion is provided with a limiting sliding groove (15) cooperating with a limiting slide (14) extending downwards from an inner surface of a top surface of the housing (1).

6. The inner red-dot gun sighting device with the crosshair according to claim 5, wherein a lower cover (16) located under the slide (12) is provided on a bottom surface of the housing (1), and three fixing screw holes (17) and at least one draining hole (18) are provided on the lower cover (16).

7. The inner red-dot gun sighting device with the crosshair according to claim 5, wherein a horizontal adjusting screw (34) is mounted on a right surface of the housing (1) at a place corresponding to the slide (12); an adjusting coil spring (35) is mounted between a left surface of the housing (1) and the slide (12); the adjusting coil spring (35) is nested on a limiting column (36).

8. The inner red-dot gun sighting device with the crosshair according to claim 7, wherein an opening stop-collar (37) that snapped and nested on the horizontal adjusting screw (34) is provided in the housing (1), so as to prevent the horizontal adjusting screw (34) from rotating due to the squeezing of the adjusting coil spring (35).

9. The inner red-dot gun sighting device with the crosshair according to claim 7, wherein in a rear end surface of the housing (1) there is provided a boost pin (38) that presses against a rear end surface of the slide (12), a boost coil spring (39) nested on the boost pin (38), and a fixing screw (40) threadingly coupled with the housing (1) and presses against a rear end of the boost coil spring (39); a front-rear limiting for the slide (12) can be achieved by means of the boost pin (38), the boost coil spring (39) and the fixing screw (40).

10. The inner red-dot gun sighting device with the crosshair according to claim 7, wherein an up and down adjusting screw (41) is provided perpendicularly at a rear end of the housing (1), which is threadingly coupled with an adjusting disc (42) provided in the rear end of the housing (1) and imbed-coupled with the rear end surface of the slide (12).

11. The inner red-dot gun sighting device with the crosshair according to claim 5, wherein in a rear end surface of the housing (1) there is provided a boost pin (38) that presses against a rear end surface of the slide (12), a boost coil spring (39) nested on the boost pin (38), and a fixing screw (40) threadingly coupled with the housing (1) and presses against a rear end of the boost coil spring (39); a front-rear limiting for the slide (12) can be achieved by means of the boost pin (38), the boost coil spring (39) and the fixing screw (40).

12. The inner red-dot gun sighting device with the crosshair according to claim 5, wherein an up and down adjusting screw (41) is provided perpendicularly at a rear end of the housing (1), which is threadingly coupled with an adjusting disc (42) provided in the rear end of the housing (1) and imbed-coupled with the rear end surface of the slide (12).

13. The inner red-dot gun sighting device with the crosshair according to claim 4, wherein a left trapped rail and a right trapped rail that extend axially are provided on a bottom surface of the housing (1); a dovetail block (19) is provided on the left trapped rail, and is threadingly coupled with a locking screw (20) penetrated from the right trapped rail;

the housing (1) is coupled with a barrel coupling sleeve through the left trapped rail and the right trapped rail;

the barrel coupling sleeve is constituted by a supporting tube (21) with an axial duct (43) provided therein and a case (22) nested outside the supporting tube;

the supporting tube (21) comprises a quadrangular prism (23) and a circular end surface (24) provided at a front end of the quadrangular prism (23); a axially extending limiting beam (25, 26) is provided on each bottom end of a left surface and a right surface of the quadrangular prism (23); a sliding groove (27) extending axially and protruding downwards beyond a bottom surface of the quadrangular prism (23) is provided at the bottom surface of the quadrangular prism;

a fixing trapped rail (28) axially extending backwards from the circular end surface (24) and clamped by the left trapped rail and the right trapped rail is provided at a front end of the top surface of the quadrangular prism (23); a first screw hole (29) penetrating the axial duct (43) is provided behind the fixing trapped rail (28);

an axially extending hole groove (30) for insertion of the left trapped rail and the right trapped rail is provided at a front end of a top surface of the case (22); an axially extending elongated groove (31) is located at the top surface of the case (22) behind the hole groove (30); and a second screw hole (32) is provided on the elongated groove (31);

a downward protruding chamber (33) for accommodating the sliding groove (27) is provided at the front end of the bottom surface of the case (22); the downward protruding chamber (33) is coupled with the sliding groove (27) by a screw.

14. The inner red-dot gun sighting device with the crosshair according to claim 13, wherein the axial duct (43) has an inner diameter decreasing gradually from a front end to a rear end of the supporting tube (21); the rear end of the case (22) has a truncated cone shape which becomes thinner gradually from front to rear.

15. The inner red-dot gun sighting device powered by the solar cell and provided with the micro-current LED light source according to claim 4, wherein the solar cell (2) is any one of a monocrystalline silicon cell, a polycrystalline silicon cell, a silicon photodiode cell or a low-light amorphous silicon solar cell.

16. The inner red-dot gun sighting device powered by the solar cell and provided with the micro-current LED light source according to claim 1, wherein the solar cell (2) is imbed-mounted at a top surface or an end surface of the front end of the housing (1), and a protection glass is provided at a top surface of the solar cell (2).

17. The inner red-dot gun sighting device powered by the solar cell and provided with the micro-current LED light source according to claim 1, wherein the solar cell (2) is any one of a monocrystalline silicon cell, a polycrystalline silicon cell, a silicon photodiode cell or a low-light amorphous silicon solar cell.

18. The inner red-dot gun sighting device powered by the solar cell and provided with the micro-current LED light source according to claim 1, wherein the solar cell (2) is imbed-mounted at a top surface or an end surface of the front end of the housing (1), and a protection glass is provided at a top surface of the solar cell (2).

* * * * *